US009551106B2

(12) United States Patent
Burke

(10) Patent No.: US 9,551,106 B2
(45) Date of Patent: Jan. 24, 2017

(54) STEAM IRON AND BURN PREVENTION APPARATUS

(71) Applicant: Samuel Burke, Stafford, VA (US)

(72) Inventor: Samuel Burke, Stafford, VA (US)

( * ) Notice: Subject to any disclaimer, the term of this patent is extended or adjusted under 35 U.S.C. 154(b) by 0 days.

(21) Appl. No.: 14/717,520

(22) Filed: May 20, 2015

(65) Prior Publication Data

US 2016/0340824 A1 Nov. 24, 2016

(51) Int. Cl.
*D06F 75/40* (2006.01)
*D06F 75/36* (2006.01)

(52) U.S. Cl.
CPC ..... *D06F 75/40* (2013.01); *D06F 75/36* (2013.01)

(58) Field of Classification Search
CPC ..... D06F 75/00; D06F 75/08; D06F 75/10; D06F 75/18; D06F 75/30; D06F 75/36; D06F 65/38; D06F 75/40
See application file for complete search history.

(56) References Cited

U.S. PATENT DOCUMENTS 2,076,614 A * 4/1937 Bowman ..... D06F 75/40 38/74
2,161,009 A * 6/1939 Brave ..... D06F 75/38 38/77.3
2,462,319 A * 2/1949 Hawkins ..... D06F 79/02 248/117.7
3,785,599 A 1/1974 Ramirez
5,108,056 A 4/1992 McBounds
5,535,534 A * 7/1996 Li ..... D06F 75/36 38/95
5,852,279 A 12/1998 Mak
5,966,851 A 10/1999 Serpa
6,226,904 B1 5/2001 Brady et al.
6,260,295 B1 7/2001 Nickel
6,384,379 B1 5/2002 Reime
6,446,371 B2 9/2002 Wehrwein
6,715,222 B2 * 4/2004 Hecht ..... D06F 75/40 38/79
7,406,783 B2 8/2008 Alipour
2004/0138004 A1 * 7/2004 Grace ..... A63B 53/0487 473/340

* cited by examiner

*Primary Examiner* — Ismael Izaguirre
(74) *Attorney, Agent, or Firm* — Dale J. Ream

(57) ABSTRACT

A steam iron and burn prevention apparatus includes an iron body having a bottom plate opposite a top plate with a side wall extending generally vertically between the bottom and top plates. The apparatus includes an iron guard having an upper portion and a lower portion, the upper portion having a generally inverted U-shaped configuration defining an open bottom and an interior area, the lower portion being movable between a retracted configuration substantially situated inside the interior area and an extended configuration substantially displaced from the interior area. The iron guard includes a plurality of biasing members coupled to the lower portion and extending upwardly into engagement with the upper portion, the plurality of biasing members biasing the upper portion away from the lower portion to the extended configuration.

19 Claims, 5 Drawing Sheets

STEAM IRON AND BURN PREVENTION APPARATUS

BACKGROUND OF THE INVENTION

This invention relates generally to steam irons and, more particularly, to a steam iron and burn prevention apparatus having an iron guard having a lower portion that is movable between a retracted configuration substantially situated inside an interior area and an extended configuration substantially displaced from the interior area. The lower portion's position is regulated by biasing members such as springs.

Operation of a steam iron (also known as a flatiron or clothing iron) to flatten or smooth clothing by removing creases can sometimes be a dangerous task in that an operator's fingers may unintentionally come into contact with the hot surface of the steam iron or be contacted by escaping steam. Even worse, the hot side of the iron may be touched by an unsuspecting third party such as a child.

Various devices and patent designs have been proposed to discourage or prevent a person from coming into direct contact with a dangerously hot surface of a steam iron. Although presumably effective for their intended purposes, the existing product and patent proposals do not provide an iron guard having a lower portion that is selectively movable between a retracted configuration situated inside an interior area defined by an upper portion and an extended configuration displaced from the interior area.

Therefore, it would be desirable to have a steam iron and burn prevention apparatus that includes a burn guard having a lower portion that is movable between a retracted configuration substantially situated inside an interior area defined by an upper portion and an extended configuration substantially displaced from the interior area. Further, it would be desirable to have a steam iron and burn prevention apparatus in which the position of the lower portion of the burn guard is regulated by biasing members such as springs.

SUMMARY OF THE INVENTION

A steam iron and burn prevention apparatus according to the present invention includes an iron body having a bottom plate opposite a top plate with a side wall extending generally vertically between the bottom and top plates. The apparatus includes an iron guard having an upper portion and a lower portion, the upper portion having a generally inverted U-shaped configuration defining an open bottom and an interior area, the lower portion being movable between a retracted configuration substantially situated inside the interior area and an extended configuration substantially displaced from the interior area. The iron guard includes a plurality of biasing members coupled to the lower portion and extending upwardly into engagement with the upper portion, the plurality of biasing members biasing the upper portion away from the lower portion to the extended configuration.

Therefore, a general object of this invention is to provide a steam iron and burn prevention apparatus that prevents a user from unintentionally coming into physical contact with the hot plate or a steam iron.

Another object of this invention is to provide a steam iron and burn prevention apparatus, as aforesaid, in which the steam iron includes a burn guard having a lower portion that is movable between a retracted configuration substantially situated inside an interior area defined by an upper portion and an extended configuration substantially displaced from the interior area.

Still another object of this invention is to provide a steam iron and burn prevention apparatus, as aforesaid, in which the position of the lower portion of the burn guard is regulated by biasing members such as springs.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A steam iron and burn prevention apparatus according to a preferred embodiment of the present invention will now be described with reference to FIGS. 1 to 3*e* of the accompanying drawings. The steam iron and burn prevention apparatus 100 generally includes an iron body 110 and an iron guard 120 surrounding the iron body 110.

Figure 1A:
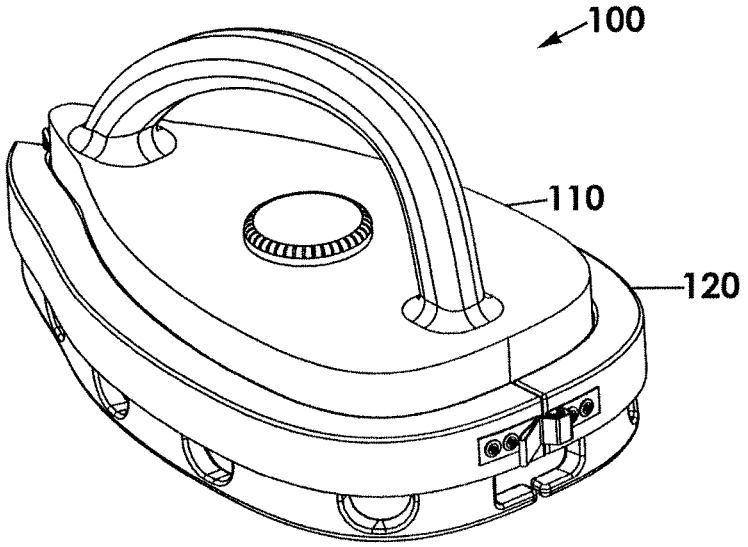
FIG. 1*a* is a perspective view of a steam iron and burn prevention apparatus according to a preferred embodiment of the present invention illustrated with the burn guard in a closed configuration.
Figure 1B:
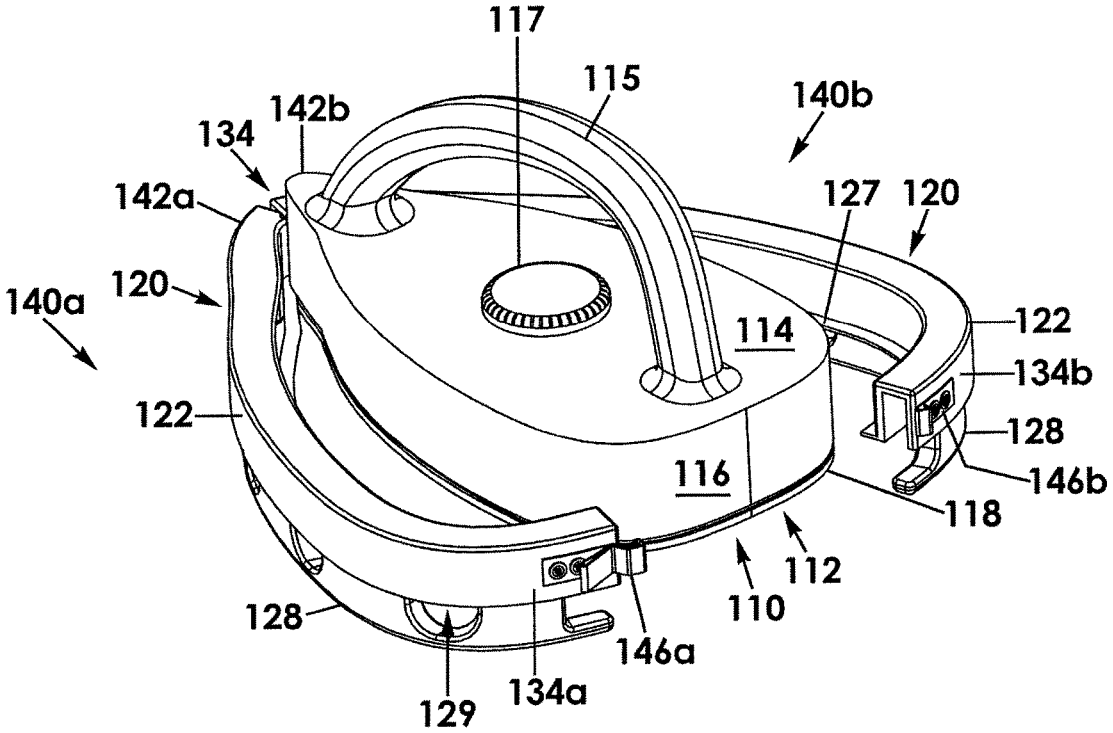
FIG. 1*b* is a perspective view of the apparatus as in FIG. 1 with the burn guard in an open configuration.

With reference to FIG. 1*b*, the iron body 110 may include a bottom plate 112 and a top plate 114. A continuous side wall 116 may extend vertically between the bottom plate 112 and the top plate 114 to form the iron body 110. A groove 118, illustrated in FIG. 3*e*, may extend around the circumference of the side wall 116 substantially adjacent the bottom plate 112 for engaging with the iron guard 120 as described below. Additionally, various components for operating the iron, such as a handle 115 or temperature dial 117, for example, may be secured to the top plate 114.

While the iron body 110 is shown as having a generally triangular shape common to traditional iron bodies, the iron body 110 may have any desired shape. Furthermore, the iron body 110 may be constructed of any appropriate suitable material, such as aluminum or steel.

Figure 2A:
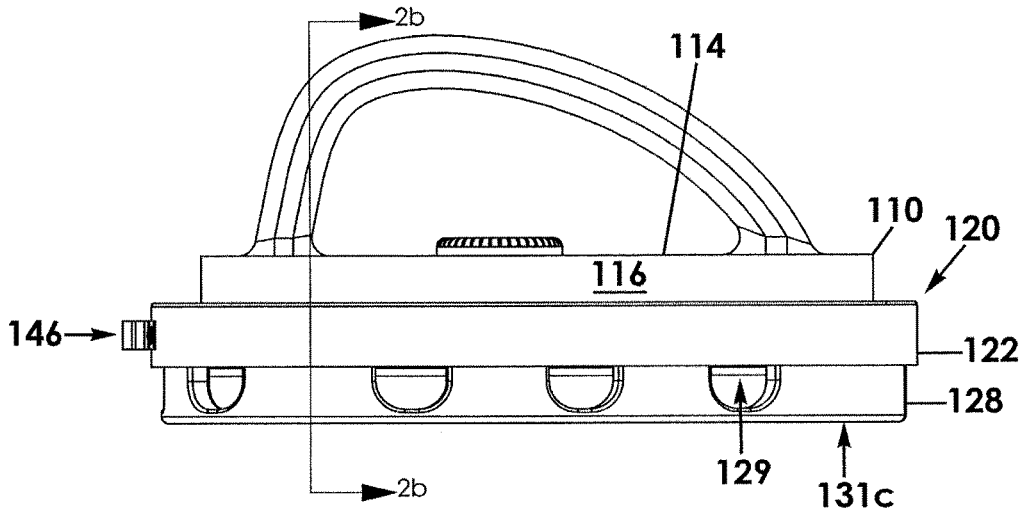
FIG. 2*a* is a side view of the apparatus as in FIG. 1*a* illustrated with the burn guard in an extended configuration.
Figure 2C:
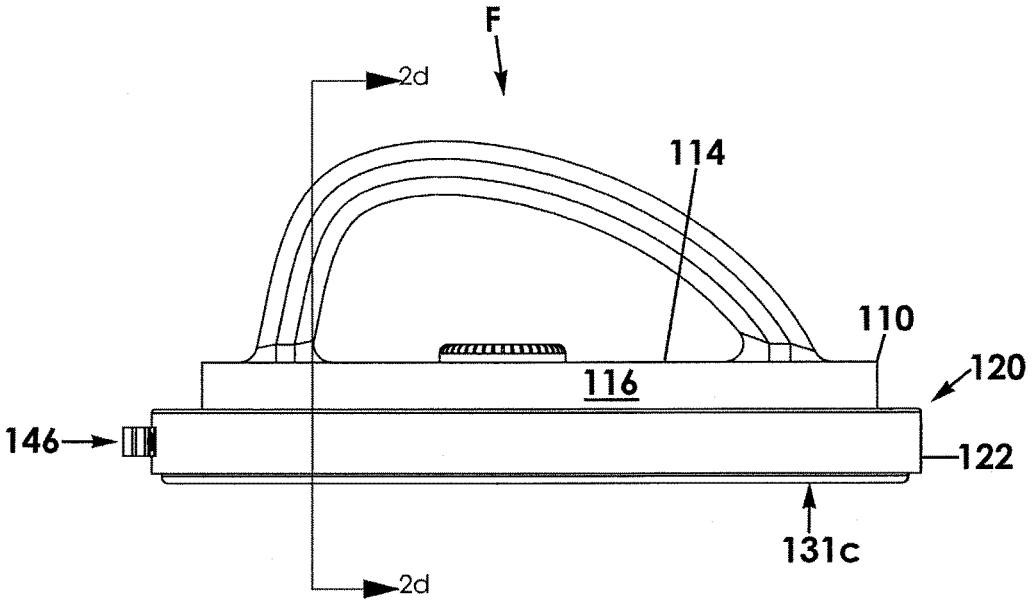
FIG. 2*c* is a side view of the apparatus as in FIG. 1*a* illustrated with burn guard in a retracted configuration.
Figure 2B:
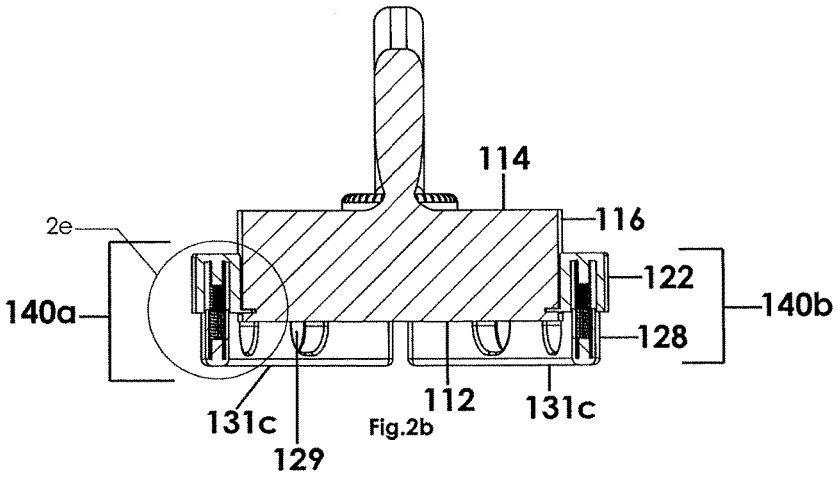
FIG. 2*b* is a sectional view taken along line 2*b*-2*b* of FIG. 2*a;*
Figure 2D:
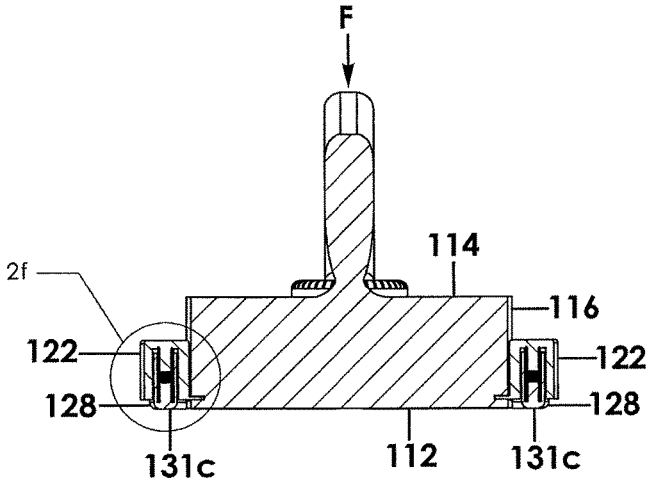
FIG. 2*d* is a sectional view taken along line 2*d*-2*d* of FIG. 2*c;*
Figure 2E:
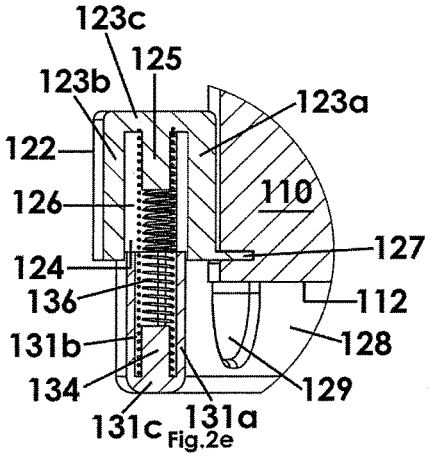
FIG. 2*e* is an isolated view on an enlarged scale taken from FIG. 2*b;*
Figure 2F:
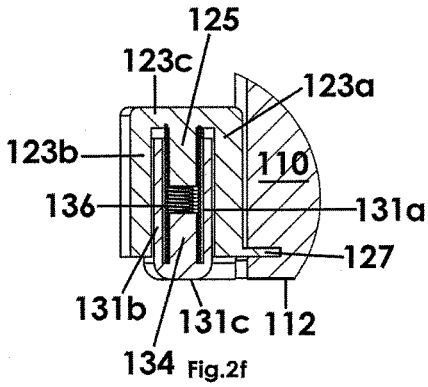
FIG. 2*f* is an isolated view on an enlarged scale taken from FIG. 2*d;*
Figure 3A:
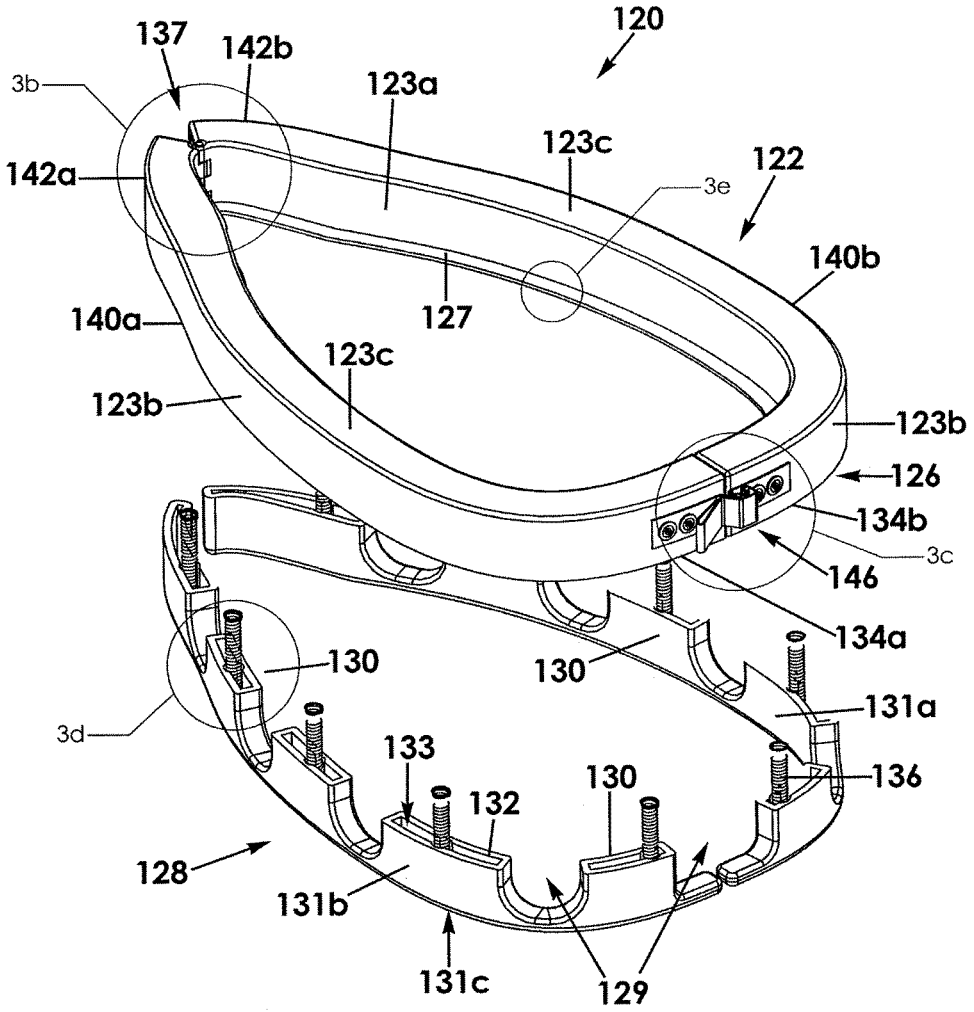
FIG. 3*a* is an exploded view of the burn guard.
Figure 3B:
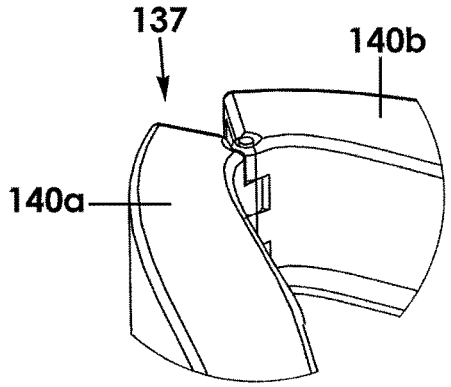
FIG. 3*b* is an isolated view on an enlarged scale taken from FIG. 3*a;*

Referring now to FIG. 3*a*, the iron guard 120 may include an upper portion 122 and a lower portion 128, each designed to correspond to the shape of the iron body 110. As shown in FIG. 2*e*, the upper portion 122 may have a generally inverted U-shaped configuration having opposed vertical walls 123*a*, 123*b*, and a flange 123*c* extending therebetween, thus defining an open bottom 124 and an interior area 126. A projection member 125 (FIG. 2*e*) may extend from the flange 123 into the interior area 126 leaving space between the projection member 125 and the vertical walls 123*a*, 123*b*.

A tongue 127 may extend inwardly from the innermost vertical wall (e.g., 123*a*) towards the iron body 110. The tongue 127 may be configured for receipt by the groove 118 when the iron guard 120 is secured around the iron body 110. Thus, the iron guard 120 may be maintained in a preferable position with respect to the iron body 110.

Figure 3C:
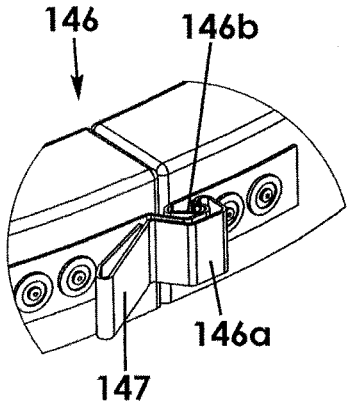
FIG. 3*c* is an isolated view on an enlarged scale taken from FIG. 3*a;*
Figure 3D:
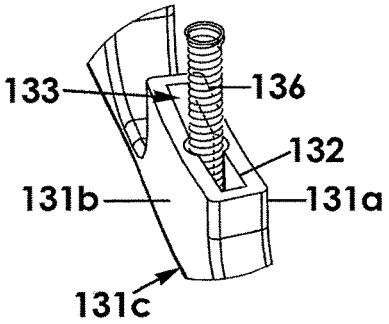
FIG. 3*d* is an isolated view on an enlarged scale taken from FIG. 3*a*.
Figure 3E:
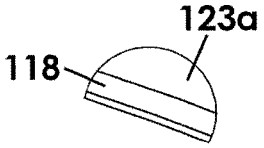
FIG. 3*e* is an isolated view on an enlarged scale taken from FIG. 3*a*.

The lower portion 128 may generally correspond to the upper portion 122 such that, in a retracted configuration the lower portion 128 fits substantially inside the upper portion interior area 126 as shown in FIGS. 2*c*-2*f*. As shown in FIGS. 2*e*, 2*f*, 3*a*, and 3*d*, the lower portion 128 may have a generally U-shaped configuration having vertical walls 131*a*, 131*b*, and a flange 131*c* (working surface contact member) extending therebetween, thus defining an open top 132 and an interior area 133. A projection member 134 (FIG. 2*e*) may extend from the flange 131*c* into the interior area 133 leaving space between the projection member 134 and the vertical walls 131*a*, 131*b*. Recessed areas 129 may form apertures in the lower portion 128. The recessed areas 129 may thus leave heightened areas 130 from which the biasing members 136 may extend as described below, and as illustrated in FIG. 3*d*.

Biasing members 136 may be disposed on the projection members 125, 134 between the upper portion 122 and the lower portion 128. The biasing members 136 may be, for example, compression springs. At an extended position, illustrated in FIGS. 2*a*, 2*b*, and 2*e*, the basing members 136 may be in a normal, non-compressed state thus biasing the lower portion 128 away from the upper portion 122. In the non-compressed state, the lower portion 128 extends beyond the bottom plate 112 of the iron body 110 so that the iron body 110 is held away from the work surface.

Exerting a force (e.g., force F at FIG. 2*c*) upon the iron body 110 (for example, at the handle 115) may cause the biasing members 136 to become compressed. With the biasing members 136 in a compressed state, illustrated in FIGS. 2*c*, 2*d*, and 2*f*, the lower portion 128 may be received inside the upper portion interior area 126. More particularly, the lower portion vertical walls 131*a*, 131*b* are received into the interior area 126 around the projection member 125 so that the biasing member 136 is held in the compressed state between the projection members 125, 134. In the compressed position, the lower portion flange 131*e* may be level with the bottom plate 112 of the iron body 110 so that the iron body bottom plate 112 may contact the work surface.

When the force F is decreased a sufficient amount, the tension in the biasing members 136 may return to normal and the lower portion 128 may again be biased away from the upper portion 122.

The biasing members 136 may be adhered to the projection members 125, 134 so as to keep the upper portion 122 and the lower portion 128 in communication with each other. Other alternate means for keeping the upper portion 122 and the lower portion 128 in communication may also be acceptable, such as, for example, string or chain that may prevent the lower portion 128 from falling away from the upper portion 122 but that may collapse when the lower portion 128 is in the compressed position. Or, in still another alternative, the biasing members 136 may be snuggly received around the projection members 125, 134 which may act to hold the basing members 136 in place and prevent the lower portion 128 from falling away from the upper portion 122.

The iron guard 120 may be arranged as a first section 140*a* and a second section 140*b*. A first section proximal end 142*a* may be in hinged communication with a second section proximal end 142*b*. Thus, the iron guard 120 may be movable between a closed configuration (FIG. 1*a*) in which the iron guard 120 is coupled to the iron body 110 at the groove 118 and tongue 127 connection described above, and an open configuration (FIG. 1*b*) in which the iron guard 120 is displaced from the iron body 110. The hinged connection is further illustrated in FIG. 3*b*.

In the closed position, a distal end 134*a* of the first section 140*a* may abut a distal end 134*b* of the second section 140*b*. The sections 140*a*, 140*b* may be held in the closed position with a latch 146, such as a spring latch as shown in FIG. 3*c*. The latch 146 may include an engaging portion 146*a* and a stopper portion 146*b*. In the closed position, the latch's engaging portion 146*a* may snap around the stopper portion 146*b* thus resulting in the latch being in a locked position. To open the sections 140*a*, 140*b*, a lever 147 on the engaging portion 146*a* may be pressed to release the engaging portion 146*a* from the stopper portion 146*b*. The sections 140*a*, 140*b* may then be disengaged from the iron body 110 by removing the tongue 127 from the groove 118. It shall be noted that other types of appropriate latching mechanisms may also be used to keep the sections 140*a*, 140*b* closed.

In use, the iron guard 120 may be placed around the iron body 110 such that the tongue 127 is selectively nestled in the groove 118 and the latch portions 146*a*, 146*b* are engaged to hold the guard 120 in the closed position. With the biasing members 136 in the normal position, the lower portion 128 is biased away from the upper portion 122 such that the lower portion 128 extends beyond the bottom plate 112. The iron body 110 is then heated.

While the biasing members 136 are still in the normal position, steam exiting from the iron body 110 may be allowed to exit through the apertures 129. When desired, a force F is applied to the iron body 110 sufficient to overcome the normal tension in the biasing members 136. The force F causes the lower portion 128 to be received by the upper portion 122 as described above. The bottom plate 112 may then be in contact with the working surface and the iron 110 may be used as desired. When the force F exerted on the handle is decreased, the lower portion 128 automatically returns to the extended position.

It is understood that while certain forms of this invention have been illustrated and described, it is not limited thereto except insofar as such limitations are included in the following claims and allowable functional equivalents thereof.

The invention claimed is:

1. A steam iron and burn prevention apparatus, comprising:

an iron body having a bottom plate opposite a top plate with a side wall extending generally vertically between said bottom and top plates; and an iron guard having an upper portion and a lower portion, said upper portion having a generally inverted U-shaped configuration defining an open bottom and an interior area, said lower portion being movable between a retracted configuration substantially situated inside said interior area and an extended configuration substantially displaced from said interior area;

wherein said iron guard includes a plurality of biasing members coupled to said lower portion and extending upwardly into engagement with said upper portion, said plurality of biasing members biasing said upper portion away from said lower portion to said extended configuration;

wherein said upper and lower portions are arranged as a first section having a first section proximal end and a second section having a second section proximal end pivotally coupled to said first section proximal end such that said iron guard is movable between a closed configuration coupled to said iron body and an open configuration displaced from said iron body.

2. The steam iron and burn prevention apparatus as in claim 1, wherein:

said first section has a first section distal end and said second section has a second section distal end; and at latch mechanism at said first section distal end and said second section distal end selectively maintains said iron guard in said closed configuration.

3. The steam iron and burn prevention apparatus as in claim 2, wherein:

said side wall of said iron body defines a circumferentially-extending groove adjacent said bottom plate; and said iron guard includes a tongue selectively nested in said groove when said iron guard is in said closed configuration.

4. The steam iron and burn prevention apparatus as in claim 3, wherein, in said extended configuration, said iron guard lower portion extends below said iron body bottom plate.

5. The steam iron and burn prevention apparatus as in claim 4, wherein, in said retracted configuration, said biasing members are compressed between said iron guard lower portion and said iron guard upper portion such that said iron guard lower portion is substantially even with said iron body bottom plate.

6. The steam iron and burn prevention apparatus as in claim 5, wherein said latch mechanism includes a spring latch.

7. The steam iron and burn prevention apparatus as in claim 6, wherein said biasing members are compression springs.

8. The steam iron and burn prevention apparatus as in claim 7, wherein said iron guard lower portion further defines a plurality of laterally spaced recessed areas, said biasing members extending between said laterally spaced recessed areas.

9. A steam iron and burn prevention apparatus, comprising:

an iron body, comprising:

a top plate;

a bottom plate; and a sidewall extending between said top plate and said bottom plate; and an iron guard operatively coupled to said iron body and comprising:

an upper portion; and a lower portion positionally-biased relative to said upper portion via a plurality of biasing members;

wherein:

said upper portion has a generally inverted U-shaped configuration comprising opposed vertical walls and a flange extending therebetween collectively forming an open bottom and an interior area;

said lower portion has a generally U-shaped configuration comprising opposed vertical walls and a flange extending therebetween collectively forming an open top and an interior area;

said lower portion further defines a plurality of laterally spaced recessed areas; and said lower portion is configured to be substantially received into said upper portion.

10. The steam iron and burn prevention apparatus as in claim 9, wherein:

a first projection member extends from said upper portion flange into said upper portion interior area;

a second projection member extends from said lower portion flange into said lower portion interior area; and said plurality of biasing members are disposed between said first projection member and said second projection member.

11. The steam iron and burn prevention apparatus as in claim 10, wherein, in a normal configuration, said biasing members bias said lower portion away from said upper portion such that said lower portion extends below said iron body bottom plate.

12. The steam iron and burn prevention apparatus as in claim 11, wherein, in a retracted configuration, said biasing members are compressed between said upper portion and said lower portion such that said lower portion flange is substantially even with said iron body bottom plate.

13. The steam iron and burn prevention apparatus as in claim 9, wherein said upper portion and said lower portion are arranged as a first section having a first section proximal end and a first section distal end and a second section having a second section proximal end and a second section distal end, said first section proximal end being pivotally coupled to said first section proximal end such that said iron guard is movable between a closed configuration and an open configuration.

14. The steam iron and burn prevention apparatus as in claim 13, wherein said first distal end and said second distal end are equipped with a reciprocating latching mechanism, said latch mechanism being automatically engaged when said iron guard is in said closed configuration.

15. The steam iron and burn prevention apparatus as in claim 9, wherein:

said sidewall of said iron body defines a groove extending circumferentially thereabout adjacent said bottom plate; and said iron guard upper portion includes a tongue configured to be selectively received by said groove when said iron guard is in said closed configuration.

16. The steam iron and burn prevention apparatus as in claim 15, wherein said latch mechanism is a spring latch.

17. The steam iron and burn prevention apparatus as in claim 16, wherein said biasing members are compression springs.

18. A steam iron and burn prevention apparatus, comprising:

an iron body, comprising:

a top plate;

a bottom plate; and a sidewall extending between said top plate and said bottom plate, said sidewall having groove extending circumferentially thereabout;

an iron guard, comprising:

an upper portion having an inner vertical side wall, an outer vertical side wall, and a horizontal flange extending therebetween; and a lower portion having an inner vertical side wall, an outer vertical side wall, and a horizontal flange extending therebetween; and a plurality of biasing members extending between said upper portion and said lower portion;

wherein:

said upper portion inner vertical side wall has a tongue extending perpendicularly therefrom away from said outer side wall, said tongue being received into said iron body sidewall groove;

said biasing members bias said lower portion between a retracted configuration substantially situated inside said upper portion and an extended configuration substantially displaced from said upper portion.

19. The steam iron and burn prevention apparatus of claim 18, wherein:

in said retracted configuration, said lower portion is substantially even with said bottom plate; and in said extended configuration, said lower portion extends below said bottom plate.

* * * * *